United States Patent [19]

Van Auken

[11] 4,084,819

[45] Apr. 18, 1978

[54] GOLF CLUB SHAFT FOR IRONS

[75] Inventor: Richard L. Van Auken, Somerville, N.J.

[73] Assignee: Exxon Research & Engineering Co., Linden, N.J.

[21] Appl. No.: 738,277

[22] Filed: Nov. 2, 1976

[51] Int. Cl.[2] ..... A63B 53/10

[52] U.S. Cl. ..... 273/80 R; 273/DIG. 7; 273/DIG. 23

[58] Field of Search ..... 273/67 R, 72 A, 73 R, 273/73 C, 73 F, 73 K, 80 R, 80 B, 80.2–80.9, DIG. 3, DIG. 6, DIG. 7, DIG. 8, DIG. 9; 43/18 GF; 428/36, 105–114, 188, 366, 367, 398

[56] References Cited

U.S. PATENT DOCUMENTS

| | | | |
|---|---|---|---|
| 1,792,034 | 2/1931 | Reach | 273/80 B X |
| 1,796,274 | 3/1931 | Bryant | 273/80 B X |
| 2,573,361 | 10/1951 | Rodgers et al. | 273/DIG. 7 |
| 2,822,175 | 2/1958 | Redmond | 273/80 B X |
| 3,313,541 | 4/1967 | Benkoczy et al. | 273/80 R |
| 3,870,086 | 3/1975 | Stark | 273/80 B X |
| 3,963,239 | 6/1976 | Fujii | 273/72 A |

FOREIGN PATENT DOCUMENTS

| | | | |
|---|---|---|---|
| 555,027 | 7/1943 | United Kingdom | 273/80 B |
| 815,780 | 7/1959 | United Kingdom | 273/80 R |
| 1,261,541 | 1/1972 | United Kingdom | 273/80 R |
| 1,399,941 | 7/1975 | United Kingdom | 273/80 R |

*Primary Examiner*—Richard J. Apley
*Attorney, Agent, or Firm*—Joseph J. Dvorak

[57] ABSTRACT

A composite golf shaft for use with a metal golf club head is improved by reinforcing the tubular metal core of the shaft with a unidirectional graphite fiber reinforced resin body which is inserted in the tip section of the shaft.

6 Claims, 10 Drawing Figures

GOLF CLUB SHAFT FOR IRONS

BACKGROUND OF THE INVENTION

This invention relates to composite golf shafts having a tubular metallic core and a graphite filter reinforcing layer superimposed thereon. More particularly, the present invention is concerned with golf shafts for the irons in a set of golf clubs.

A considerable amount of effort has been expended in the past to remedy the deficiencies of tubular metal golf shafts by coating the metal tube with a resin-impregnated glass fiber. The use of such resin-impregnated glass fiber coatings on tubular metal shafted golf clubs provides a dampening effect on the vibrations normally experienced during play with such clubs. Unfortunately, however, such coatings have introduced other changes in the playing characteristics of the club employing such resin-impregnated glass fiber coatings.

In copending application Ser. No. 711,284, filed Aug. 3, 1976, a vastly improved composite golf shaft is disclosed which has at least two superimposed strips of sheet material of a resin-impregnated unidirectional continuous graphite fiber-reinforcement spirally wound on top of a tapered metal tubular shaft and a layer of woven fiberglass interposed between alternating strips of the resin-impregnated graphite fiber reinforcement. The shaft additionally and significantly has a layer of structural adhesive interposed between the first layer of resin-impregnated unidirectional graphite fiber reinforcing material and the metal core. One of the significant advantages of the aforementioned graphite fiber reinforced tubular metal golf club shaft is its relatively low weight. A golf club with such a low shaft weight has a lower center of gravity, thereby enhancing the effectiveness of the hitting mass.

As is readily appreciated, golf clubs are generally referred to as "woods" or "irons", depending upon the physical characteristics of the golf club head and shaft. For example, "woods" have club heads generally substantially fabricated from wood, although they do have a metal face, i.e. a striking surface for hitting the golf ball. Also, "woods" have shafts that are longer than shafts of "irons". The "irons" have heads, of course, which are fabricated substantially entirely from a metal, such as steel. Golf club irons typically have shafts that have larger tip diameters than golf club woods. As will be appreciated, the stresses to which a golf club shaft is subjected is a function, in part, of the type of head employed, e.g., whether it is an iron head or a wood head, as well as its intended use in play. Indeed, it has been found that golf clubs having heads formed from metals and shafts having tubular metal cores with fiber-reinforced layer superimposed thereon frequently suffer failure, i.e. breakage, near the point where the shaft joins the club head.

SUMMARY OF THE INVENTION

It has now been discovered that a composite golf club shaft for use as an iron can be vastly improved by further reinforcing the tubular metal core of the shaft by means of a tubular, unidirectional graphite fiber reinforced, resin body which is inserted in and adhesively bonded to the inner surface of the tubular core in the tip section thereof. Thus, in one embodiment of the present invention, there is provided an improved composite golf shaft having a tubular metal core and a fiber-reinforced resin sheath in the exterior thereof and, in the tip section of the tubular shaft, a graphite fiber reinforced tubular body inserted therein and bonded thereto. The continuous unidirectional graphite fibers have a predetermined orientation with respect to the longitudinal axis of the shaft. More particularly, the continuous graphite fibers in the tip section resin insert are oriented at 0° with respect to the longitudinal axis of the shaft.

These and other features of the present invention will be more completely understood by the reading of the Detailed Description which follows and in light of the drawings appended hereto.

DETAILED DESCRIPTION OF THE INVENTION

Figure 1:
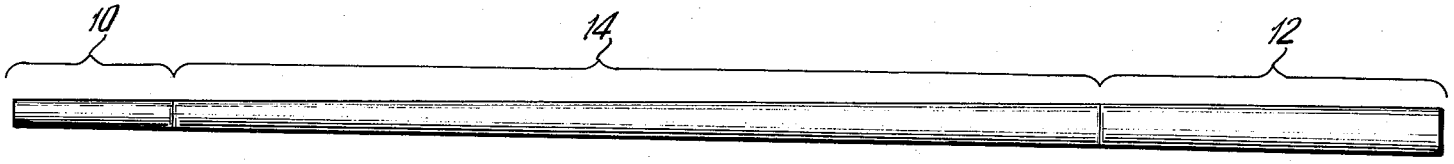
FIG. 1 illustrates, in reduced scale, the tapered tubular core used in forming the golf shaft of the present invention.

Referring now to the drawings, it should be noted that like reference characters designate corresponding parts throughout the several drawings and views.

Figure 2:
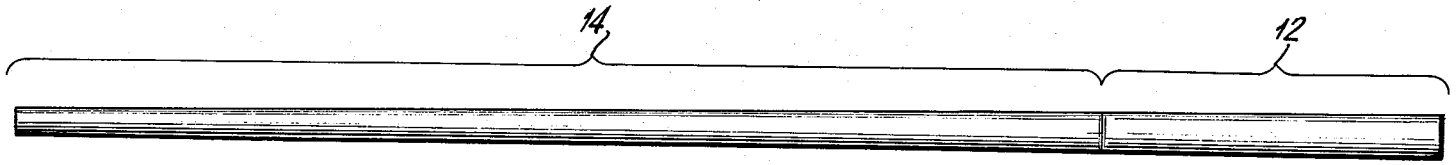
FIG. 2 illustrates, in reduced scale, an alternate metal tubular core used to form the golf shaft in accordance with the present invention.

The golf shaft of the present invention has a metal core in the form of a generally tapered hollow tube as shown in FIG. 1. The golf shaft need not be entirely tapered, but preferably will have a generally cylindrical tip section 10 and a cylindrical butt section 12 with a substantially tapered body portion 14. In the embodiment shown in FIG. 2, the butt section 12 of the tubular core is substantially cylindrical while the remainder of the metal core is tapered. Thus, the tip section 10 of the core shown in FIG. 2 is slightly tapered, this taper continuing smoothly to the body section 14. The butt section 12 is again cylindrical. In either embodiment of the tubular core, the tip section 10 generally is of the order of about 6 inches in length and certainly no greater than 8 inches in length.

Although the tubular metal core is referred to as having separate sections, it should be understood that this metal core is indeed a unitary tubular member and the sections referred to hereinabove merely refer to general areas along the length of the tube.

In order that the golf shaft will have the requisite strength and weight, it is preferred that the metal tube be fabricated from aluminum or magnesium alloys. Indeed, it is particularly preferred that the core be fabricated from the following aluminum alloys: 7178; 7075; 7049 and 7050. The foregoing numerical designations refer, of course, to U.S. alloy compositions. It is particularly preferred that these alloys have a T-6 temper. Aluminum alloys having the foregoing compositions and temper are articles of trade, readily available, that can be shaped into tubular articles by standard techniques.

Typically, the tubular core will be about 46 inches in length and have an outer diameter at the butt end of no greater than about 0.570 inches and no less than about 0.560 inches. Particularly, the butt diameter will be 0.570 inches. At the tip end of the metal core, the outer diameter of the core will be in the range of about 0.305 to about 0.315 inches and preferably 0.310 inches. Wall thickness of the metal core at the butt end of the core will be in the range of 0.015 to 0.017 inches, and preferably 0.016 inches. Wall thickness of the metal core at the tip end of the core will be in the range of 0.021 to 0.023 inches, and preferably 0.022 inches. The length of the tip section 10 and the butt section 12 will vary depending upon the type of flex desired. Typically, a tip section 10 will range anywhere from one inch to about 8 inches in length, and preferably will be about 6 inches in length. As mentioned previously, the tubular core is fabricated by well-known techniques such as drawing extruding a heavy wall cylindrical billet to the required dimensions.

Figure 3:
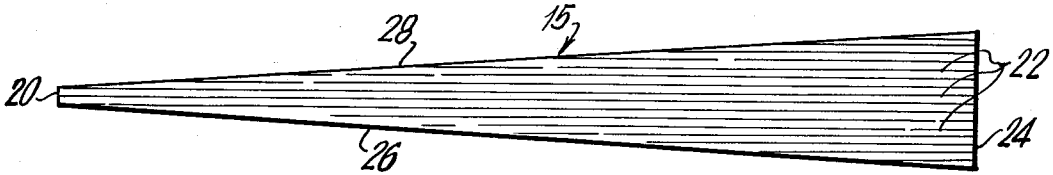
FIG. 3 diagrammatically illustrates a sheet of resin-impregnated graphite fiber reinforcing material used in forming the golf shaft of the present invention.

The golf shaft of the present invention has the metal tubular core encased in a sheet of resin-impregnated reinforcing fibers. The metal core can be encased in the sheath of resin impregnated fibers by any technique known in the art; however, it is particularly preferred in fabricating the golf shaft of the present invention that an oblong sheet or gore 15 such as that shown in FIG. 3 be cut from a sheet of unidirectional graphite fibers impregnated with a plastic resin. As is shown in FIG. 3, this gore 15 is cut in a quadrangular form wherein end edges 20 and 24 are parallel to each other but of different lengths. Lengthwise edges 26 and 28 are not parallel but provide a taper as they converge toward edge 20. The graphite fibers 22 are perpendicular to the end edges 20 and 24. The resin impregnating the graphite fibers 22 is a thermosetting resin. Suitable thermosetting resin materials include epoxy and polyester resins. Particularly, gore 15 would be about 46 inches long and in the range of 1.9 to 2.2 inches at the edge 24 and in the range of 0.9 to 1.1 inches wide at edge 20. Particularly also, gore 15 would have a thickness of about 0.007 to 0.01 inches and contain from about 50 to about 60 volume percent graphite fibers in the thermosetting resin matrix. Preferably, the gore 15 used in the present invention has a 54 to 58 volume percent of graphite fibers in an epoxy resin matrix.

The epoxy resins are polyepoxides, which are well known condensation products or compounds containing oxirane rings with compounds containing hydroxyl groups or active hydrogen atoms, such as amines, acids and aldehydes. The most common epoxy resin compounds are those of epichlorohydrin, bis-phenol and its homologs. The polyester resins are polycondensation products of polybasic acids with polyhydric alcohols. Typical polyesters include polyterphthalates such as poly(ethylene terphthalate).

As is well known in the art, these thermoset resins include modifying agents such as hardeners and the like. Forming such compositions is not a part of the present invention. Indeed, the preferred modified epoxy resin impregnated graphite fibers are commercially available materials. For example, modified epoxy pre-impregnated graphite fibers are sold under the tradename of Rigidite 5209 and Rigidite 5213 by the Narmco Division of Celanese Corporation, New York, N.Y. Other commercial sources of resin pre-impregnated graphite fibers are known in the industry.

Figure 4:
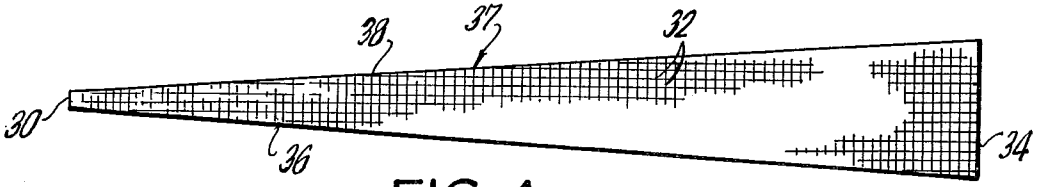
FIG. 4 diagrammatically illustrates a sheet of woven glass cloth used in forming the preferred golf shaft of the present invention.

Continuing with the preferred method of encasing the tubular core in a sheath, reference is made to FIG. 4 wherein a woven glass fabric layer or gore designated generally by reference 37 is provided. This gore 37 has the same dimensions as gore 15. In other words, end edges 30 and 34 are parallel to each other but are different lengths, whereas side edges 36 and 38 are not parallel and provide a taper as they converge toward end edge 30. This gore 37 will have a thickness of about 0.001 to about 0.002 inches and will consist of woven glass fabric; preferably a fiberglass fabric known in the trade as fiberglass scrim is used. This specially useful fiberglass scrim is Style 107 sold by Burlington Glass Fabrics Company, New York. As can be seen, the fibers 32 of the woven fiberglass fabric are at angles of 0° and 90° with respect to end edges 30 and 34.

Figure 5:
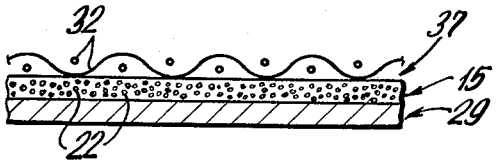
FIG. 5 is an enlarged fragmentary cross-section of an oblong blank of laminated sheet material comprising a structural adhesive layer, a graphite fiber resin impregnated layer and a fiberglass cloth layer.

In fabricating the shaft, layers or gores 15 to 37 are cut from stock material to the desired flat pattern. Each pattern is cut to the same size and shape. Layer 37 is placed on top of gore 15. The underside of gore 15, as shown in FIG. 5, is provided with a layer of structural metal adhesive 29. The metal adhesive is a material employed for bonding plastics to metals, such as elastomeric modified epoxy and elastomeric modified phenol-urea type resins. One example of one type of adhesive is a polysulfide elastomer modified epichlorohydrin bisphenol resin. Many structural adhesives are commercially available, one of which is known as Metlbond 1133 which is an elastomer modified epoxy material sold by Narmco Division of Celanese Corporation, New York, N.Y. Another is FM-123-2 sold by American Cyanamid Company, Wayne, N.J. The structural metal adhesive is applied to the underside of gore 15 by means of brushing or spraying, for example, when the physical consistency of the adhesive so permits so as to cover the entire bottom surface of gore 15. When the adhesive is a thin film of sheet material, the gore can be very simply placed on top of the laminated sheet precut to the same dimensions. In any event, the first oblong layer of laminated sheet material is provided and, as shown in FIG. 5, is composed of structural adhesive 29, the layer of continuous graphite fiber and resin matrix 15 and woven fiberglass layer 37.

In a preferred embodiment of the present invention, the weight of structural metal adhesive layer employed will generally be kept in the range of about 0.027 to about 0.033 pounds per square foot; and, indeed, it is particularly preferred that the weight of the adhesive layer 29 be about 0.03 pounds per square foot.

Figure 6:
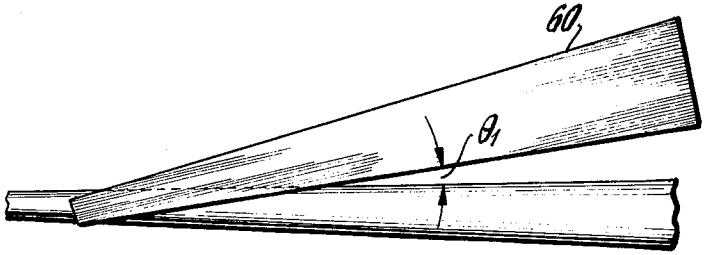
FIG. 6 is a diagrammatic illustration of the winding of an oblong blank of laminated material around the tubular metal core of the shaft of the preferred embodiment of the present invention.

As is shown in FIG. 6, the oblong laminated material consisting of structural adhesive 29, resin impregnated graphite fiber layer 15 and glass fabric layer 37 is spirally wound as a single laminated layer 60 around tubular metal core with the adhesive layer placed in contact with the tubular metal core and so arranged with respect to the axis of the metal core that the continuous graphite fibers can be considered to be arranged at an angle varying generally between 5° and 15° with respect to the longitudinal axis. This angle of orientation is shown as $\theta_1$ of FIG. 6.

Figure 7:
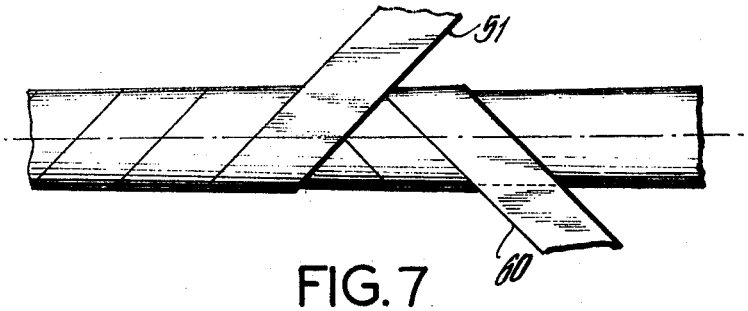
FIG. 7 is a fragmentary top plan view showing the spiral winding of two sheet materials in a tubular metal core in relationship to each other in accordance with the present invention.
Figure 8:
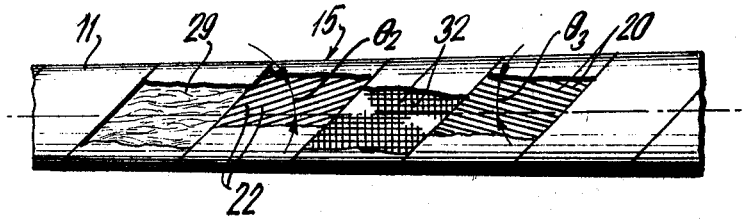
FIG. 8 is a fragmentary partial view cut away showing the various layers of material as employed in the body portion of the preferred golf shaft of the present invention.

The second oblong sheet of resin impregnated graphite fiber material is cut having the same dimensions as gore 15. The second sheet is shown in FIG. 7 by reference 51. As is shown in FIG. 7, the second graphite layer 51 is wrapped in a spiral direction around the metal core so as to overlap the first laminated layer 60. More particularly, it should be noted that second graphite fiber layer 51 is wrapped spirally at an angle oppositely disposed with respect to the fibers in the first layer. This relationship is also brought out in FIG. 8 wherein the first layer 11 as shown therein is the metal tubular core upon which is next shown layer 29 of structural metal adhesive followed by layer 15 in which the graphite fibers 22 form an angle shown as $\theta_2$ with respect to the longitudinal axis of the metal tube. $\theta_2$ is generally in the range of 5° to 15°. The next layer 31 consists of woven glass fabric. Fibers 32 can be seen to be at 0° and 90° with respect to the longitudinal axis. Finally, the top layer 51 of graphite fiber reinforced resin has graphite fibers 22 which, as a result of winding, form an angle $\theta_3$ ranging from $-5°$ to about $-15°$. In all instances, the magnitude of $\theta_1$ and $\theta_2$ are the same and they are merely opposite in sign.

In wrapping laminate 60 around the metal tubular core, it is particularly preferred that there by very little overlap. Indeed, it is most preferred that each spiral wrapping abut against the preceding spiral wrapping.

Figure 9:
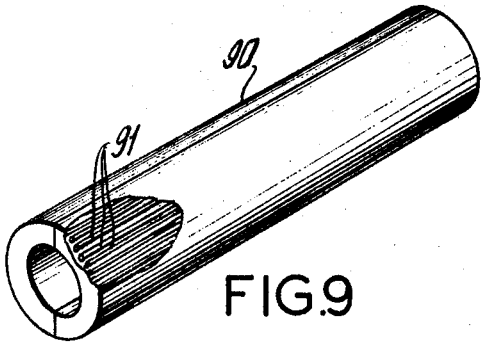
FIG. 9 is a diagrammatic illustration, partly cut away to show fiber orientation, of a graphite fiber reinforced tubular resin body for insertion in the tip section of a tubular member in accordance with the present invention.
Figure 10:
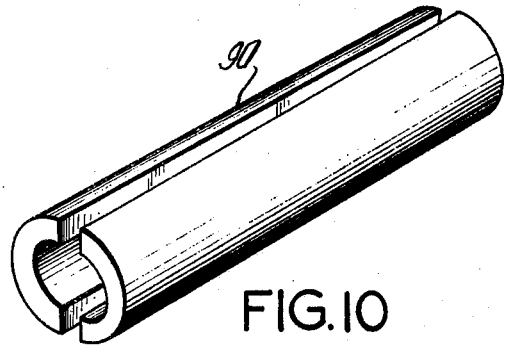
FIG. 10 is a diagrammatic illustration of two members having C-shaped cross-sections which can be joined together to form the tubular resin body of FIG. 9.

After winding laminated layer 60 and graphite fiber reinforced layer 51 around the core, these materials can be held in place by means of cellophane tape, for example. Alternatively, the assembly of core and external plastic impregnated graphite fiber reinforcing material can be held in place by a wrapping of polyethylene heat shrinkable film (not shown) which serves in effect as a mold and which is subsequently removed as hereinafter described. After wrapping the metal core with the various layers of material, the tip section of the tubular shaft is fitted with the graphite fiber reinforced tubular body 90 shown in FIG. 9. This tube is of dimensions sufficient to fit in a snug relationship with respect to the tip section of the tubular metal core to the shaft. Thus, the tubular body will be of from 1 to 8 inches in length, and preferably 6 inches in length and will generally have an outer diameter of between 0.245 inches to 0.255 inches, and preferably 0.250 inches. The inner diameter of this tubular insert will be in the range of about 0.090 to 0.105 and preferably will be 0.100 inches. Additionally, as can be seen from FIG. 9, the tubular resin body has unidirectional continuous graphite fibers 91 embedded in a resin matrix. The resin preferably is a polyester resin similar to resins of the type hereinbefore described. It should also be noted that the continuous unidirectional graphite fibers have a predetermined orientation with respect to the longitudinal axis of the shaft. Indeed, it is particularly preferred that the continuous graphite fibers 91 in the tip section resin insert be oriented at substantially 0° with respect to the longitudinal axis of the shaft. Typically, the tip section resin insert will contain 50 to 55 volume percent of graphite fibers in the polyester resin matrix. Such insert can be made by techniques which are well known in the art and form no part of the present invention. For example, the tubular member can be prepared by first pulling fibers through a bath of polyester resin material and then through a dye to form a stock material which has substantially a C-shaped cross-section of the requisite dimensions. While bonding two of such stock materials to each other, for example with radio frequency curing techniques, tubular member 90 can be obtained.

The tip section resin insert is inserted within the tubular metal core and bonded thereto by means of an adhesive, for example, two-part epoxy adhesive which is Hysol-9412, sold by Hysol, a Division of Dexter Chemical Co., Pittsburg, California, is eminently suitable.

After the metal core is provided with its exterior sheath and its tip insert, the entire assembly can be cured in an oven at elevated temperatures; for example, the entire assembly can be heated in the temperature range of about 100° to about 180° C, and preferably at about 140° C. Alternatively, after wrapping the metal core with the requisite layers of material, but prior to the insertion of the tubular tip insert, the assembly can be placed in an oven and heated to a temperature sufficient to cause bonding of the separate layers in the various convolutions to each other. Thereafter, the tip insert can be bonded with the epoxy resin adhesive in the manner described above and merely permitted to cure at room temperature, for example, for 24 hours. Alternatively, this post-introduction of the tubular tip insert can be followed by a curing at elevated temperatures, for example at 90° C for a period of about an hour.

Surface imperfections, if there are any, on the shaft can be removed by sanding, grinding and the like. Finally, the shaft can be fitted with a grip and club head. Optionally, the shaft, prior to being fitted with a grip and club head, can be painted to provide the desired color appearance.

While not wishing to be bound by any theory, the improved performance and durability of the golf shafts of the present invention can be attributed to the harmonious interaction of each of the individual components. Continuous unidirectional graphite materials generally display very low stretch or elongation factors compared to tubular metal materials such as aluminum and steel. As a result of the inclusion of these graphite fibers in the specified angle of orientation in the exterior sheath of the tubular metal core, the fiber reinforced tubular shaft has exceptional recovery. In other words, when the golf club is swung on a backswing, the shaft tends to bend backwards and on the downswing the club head is behind the hands of the hitting area. Then, the shaft begins to restore itself and the club accelerates into the hitting area. This is generally referred to as the "club head recovery". Because the graphite fibers in the sheath of the shaft of the present invention have a low stretch or elongation factor compared with conventional shaft materials, the shaft restores itself at a much higher rate. This results in a higher club head speed at impact. Consequently, at impact the strain is unusually severe, particularly in the case of club heads which are made of metal. Wooden club heads have some flexibility and vibrational dampening properties not present in the metal heads. The severity of the strains in the case of the metal head is even further heightened in view of the fact that such tubular shafts generally have greater diameters than the wooden clubs. The total effect, in any event, is that the light weight and extremely high head recovery at impact places unusually severe strain in the form of local bending or shearing of the shaft. The graphite fiber reinforced tip insert counteracts the shearing forces on impact and enhances the strength and playability of clubs fitted with this insert, particularly with respect to irons.

What is claimed is:

1. In a golf shaft having a tubular metallic core and a graphite fiber reinforced sheath on the surface thereof, said tubular metallic core having a tip section, body section and butt section, the improvement comprising: a graphite fiber reinforced tubular resin body inserted in and adhesively bonded to the interior surface of the tip section of said tubular metal core, said tubular resin body having unidirectional continuous graphite fibers embedded therein, said graphite fibers being oriented at a predetermined angle with respect to the longitudinal axis of the tubular metal core.

2. The golf shaft of claim 1 wherein said continuous unidirectional graphite fibers are oriented substantially at 0° with respect to the longitudinal axis of the shaft.

3. A graphite fiber reinforced tubular golf shaft having at tip section and body section and a butt section, said shaft comprising: a central tapered hollow aluminum alloy metal core and a sheath of at least two plies of continuous unidirectional graphite fiber reinforcement in a thermosetting resin matrix, said thermoset resin matrix being bonded to said aluminum core by means of an intermediate layer of structural metal adhesive in an amount in the range of 0.027 to 0.033 pounds per square foot, said fibers of said layers being oriented in opposite angular relationship with each other and at an angle of 5° to 15° with respect to the longitudinal axis of the shaft, said graphite fiber reinforced layers having interposed therebetween a layer of fiberglass scrim, the fibers of said fiberglass scrim being at 0° and 90° with respect to the longitudinal axis of the shaft, said metal core having in the tip section thereof a graphite fiber reinforced tubular resin body adhesively bonded to the inner surface of said tip section, said tubular resin body having continuous unidirectional graphite fibers oriented substantially at 0° with respect to the longitudinal axis of the shaft.

4. The shaft of claim 3 wherein said resin of said graphite fiber reinforced tubular resin body is a polyester and is bonded to the interior surface of said tip section of said central core by means of an epoxy resin adhesive.

5. A golf club having a metal head and a tubular metal golf shaft, said golf shaft having a tip section, body section and butt section and wherein said tubular metal shaft has a sheath of a graphite fiber reinforced thermoset resin matrix on the exterior thereof, the improvement comprising a graphite fiber reinforced tubular resin body inserted in and adhesively bonded to the inner surface of the tip section of said tubular metal shaft, said tubular resin body having continuous unidirectional graphite fibers oriented substantially at 0° with respect to the longitudinal axis of said golf shaft.

6. The golf club of claim 4 wherein said fibers are present in an amount ranging from about 50 to 58 volume percent of the tubular body.

* * * * *